US008241155B1

(12) United States Patent
Rauso

(10) Patent No.: US 8,241,155 B1
(45) Date of Patent: Aug. 14, 2012

(54) BAT SAFETY SYSTEM

(75) Inventor: Stephen Rauso, Gilbert, AZ (US)

(73) Assignee: American Coatings Corp., Phoenix, AZ (US)

( * ) Notice: Subject to any disclaimer, the term of this patent is extended or adjusted under 35 U.S.C. 154(b) by 0 days.

(21) Appl. No.: 12/546,592

(22) Filed: Aug. 24, 2009

Related U.S. Application Data

(60) Provisional application No. 61/144,107, filed on Jan. 12, 2009, provisional application No. 61/106,128, filed on Oct. 16, 2008.

(51) Int. Cl.
*A63B 59/06* (2006.01)

(52) U.S. Cl. ..... 473/564; 473/567

(58) Field of Classification Search ..... 473/457, 473/519, 520, 564–568
See application file for complete search history.

(56) References Cited

U.S. PATENT DOCUMENTS

| | | | | | |
|---|---|---|---|---|---|
| 2,804,400 | A * | 8/1957 | Kelly et al. | ..... | 473/568 |
| 3,129,003 | A * | 4/1964 | Mueller et al. | ..... | 473/568 |
| 3,716,433 | A * | 2/1973 | Plummer | ..... | 156/85 |
| 4,241,115 | A * | 12/1980 | Temin | ..... | 428/336 |
| 4,765,856 | A * | 8/1988 | Doubt | ..... | 156/212 |
| 5,254,391 | A * | 10/1993 | Davis | ..... | 428/195.1 |
| 5,491,015 | A * | 2/1996 | Reeves et al. | ..... | 428/167 |
| 5,962,368 | A * | 10/1999 | Poole | ..... | 503/227 |
| 6,036,610 | A * | 3/2000 | Lewark | ..... | 473/564 |
| 6,139,451 | A * | 10/2000 | Hillerich et al. | ..... | 473/564 |
| 6,872,157 | B2 * | 3/2005 | Falone et al. | ..... | 473/568 |
| 2004/0102264 | A1 * | 5/2004 | Gilligan et al. | ..... | 473/568 |
| 2005/0064965 | A1 * | 3/2005 | Flood | ..... | 473/568 |
| 2007/0148409 | A1 * | 6/2007 | Rios et al. | ..... | 428/167 |
| 2008/0081711 | A1 * | 4/2008 | Chauvin et al. | ..... | 473/457 |
| 2009/0312126 | A1 * | 12/2009 | Totino | ..... | 473/564 |
| 2009/0325738 | A1 * | 12/2009 | Pryor | ..... | 473/568 |

OTHER PUBLICATIONS

Ashton-Miller, James et al., "The BESR (Ball Exit Speed Ratio)", pp. 1-6.

* cited by examiner

*Primary Examiner* — Mark Graham
(74) *Attorney, Agent, or Firm* — Venable LLP; Stefan J. Kirchanski

(57) ABSTRACT

The danger of damage caused by flying fragments from a shattered baseball bat is greatly reduced or eliminated by wrapping a portion of the bat with nearly invisible polymeric film. Although extremely thin, the film shows great tensile strength and retains wood fragments should the bat shatter in use. Preferably the region of the bat where the handle portion transitions into the barrel portion is wrapped because this area is the most prone to shatter. This leaves the barrel of the bat completely unaltered. Where game rules permit thin strips of film can also be applied to the sides of the barrel as an additional precaution although the barrel is relatively unlikely to shatter in use.

12 Claims, 8 Drawing Sheets

BAT SAFETY SYSTEM

CROSS-REFERENCE TO PRIOR APPLICATIONS

The present application claims priority and benefit of U.S. Provisional Patent Applications No. 61/106,128 (filed Oct. 16, 2008) and No. 61/144,107 (filed Jan. 12, 2009, which applications are incorporated by reference to the extent permitted by applicable law.

U.S. GOVERNMENT SUPPORT

Not Applicable

BACKGROUND OF THE INVENTION

1. Area of the Art

The present invention is in the area of safety measures for sports and is more particularly directed to methods to prevent damage caused by breakage of athletic implements such as wooden bats used in playing baseball.

2. Description of the Background Art

Wood has long been for construction and fabrication of many objects ranging from buildings to furniture to tools. Wood has an unmatched combination of strength and lightness so that even in today's age of carbon fiber composites and other high technology materials wood is still in widespread use. Of course, wood does have a number of drawbacks depending on the application. Wood is flammable and can be affected by moisture: in wet situations wood may swell and distort whereas in dry situations wood may shrink and split. If wood is subjected to excess force, it may crack and fail. Nevertheless, wood is generally considered to be durable and dependable.

As a consequence, wood is often used for tool handles where its strength, relative lightness and shock absorbing properties are particularly valued. The tools are often objects used in various games such as, but not limited to, tennis racquets, golf clubs, croquet mallets, hockey sticks, cricket bats and baseball bats. It is known that these athletic tools may fail if abused or overtaxed. For example, if a wooden tennis racquet is swung so that the head of the racquet strikes a wall, the racquet head may well shatter. However, wooden athletic implements rarely fail unless misused. In the case of baseball bats although wooden bats may at times fail, it has previously been quite rare for a wooden bat to fail under the stresses of a normal game—it had been particularly unusual for bat failure to result in any significant damage.

More recently there has been a trend towards catastrophic failures of baseball bats during use. The bats shatter and wooden fragments become dangerous projectiles which have injured both players and spectators. This propinquity of baseball bats to shatter during use appears to be related to the replacement of traditional hickory and ash bats with those made of maple which bats are lighter and favored by players. When a maple bat fails, the wood shatters—virtually exploding—and large as well as small (sharp) fragments can be thrown a considerable distance. In fact, the failure of maple bats has become so pervasive that some thought has been given to banning the use of maple for safety reasons. Short of banning the use of maple, a number of more or less complex solutions to the problem have been proposed. For example, it has been suggested that bat manufacturers be forced to use CAT (computed tomography) scans and similar imaging technology to ensure that the wood used in bat manufacture is free from defects. However, there is as yet no evidence that detectable defects contribute to bat failure. Whatever defects lead to bat failure may not be readily detectable by any commonly used imaging system.

Also, it is far from clear that the failure does not develop over time in perfectly normal maple wood. Some commentators have favored the scanning and imaging the bats before or even during games. Not only is this solution unproven, it could well transform the baseball field into the image of a modern American airport—completely with lengthy delays as the bats are scanned (and possibly searched) prior to or even during play. A few commentators have even suggested that special "super maple trees" be grown ensure shatterproof wood. Unfortunately, modern forestry science is not well equipped to produce such a super tree. Furthermore, the process would be somewhat lengthy because even under ideal conditions, several years are needed to produce trees of sufficient diameter to produce baseball bats. Even then there is the distinct possibility the "super maple," if actually produced, would have the weight and density of hickory wood—thereby obviating all the advantages of maple. Clearly, there is a need of a simple method to either predict or prevent failure of wooden bats.

SUMMARY OF THE INVENTION

The present invention eliminates the danger of damage caused by flying fragments from a baseball bat that shatters during use. At least a portion of is wrapped with nearly invisible polymeric film. Although extremely thin, the film shows great tensile strength and retains wood fragments should the bat shatter in use. Preferably the region of the bat where the handle portion transitions into the barrel portion is wrapped because this area is often the most prone to shatter. This leaves the barrel of the bat completely unaltered. This is the bat structure required by current Major League Baseball rules; that is, the rules do not allow any portion of the bat barrel to be covered or modified. Where game rules permit thin strips of film can also be applied to the sides of the barrel and connect to the film wrapping the bat handle as an additional precaution against the unlikely situation where the barrel shatters in use.

The present invention can be a method for preventing damage caused by release of fragments by a wooden object shattering during use. The method is aimed towards athletic implements such as tennis racquets, golf clubs, croquet mallets, hockey sticks, cricket bats and baseball bats. The method can also be applied to other wooden tool implements such as wooden handles of awls, axes, brooms, chisels, hammers, screwdrivers and the like. According to the method any of a number of polymeric films having sufficient tensile strength can be used. The preferred films are polyurethane films, polyester films such as Mylar® (polyethylene terephthalate), polyethylene films, polypropylene films and polyamide films such as Nylon.® The films preferably come with integral adhesive although adhesive can be applied prior to use. Although a single layer of film may be adequate (i.e., one sheet of film is wrapped 360° around a round handle, the preferred method wraps the wooden surface with two overlapping layers of film with the film end butted so as to make a smooth surface. More than two layers of film can also be used. When these films are utilized to protect painted surfaces such as exposed surfaces of an automobile, it is usual to employ moisture and a tool to conform the product to the painted surface. In the case of wooden tool surfaces such as a baseball bat, moisture is normally not required for application. application without moisture makes it possible to later remove the film without damaging the protected surface.

The present invention also encompasses a baseball bat produced according to the method. Such a safety bat has a portion of the bat handle and transition region wrapped in at least one layer of the polymeric film as discussed above. The film adds very little to the weight of the bat, and testing has demonstrated that the overall physical properties of the bat in terms of game playing are essentially unaltered. The major effect of the polymeric film is to retain wood fragments when the bat shatters in use.

DETAILED DESCRIPTION OF THE INVENTION

Figure 1:
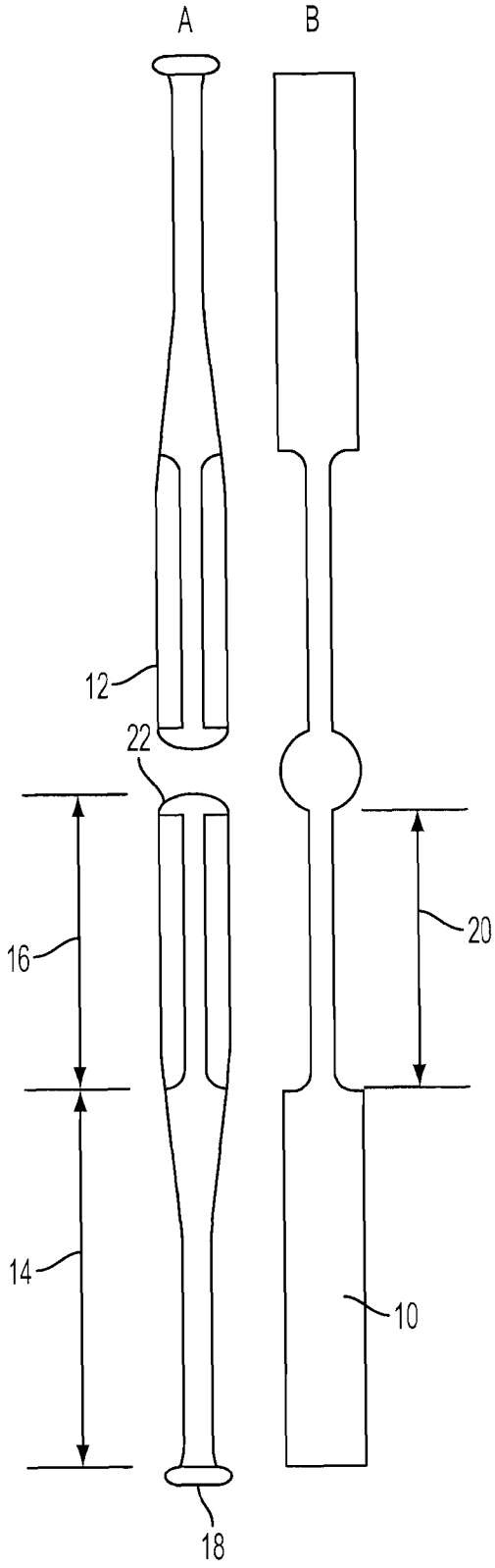
FIG. 1 shows a diagram of a wooden baseball bat and cut protective film for one embodiment of the current invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a method to reduce the likelihood of damage from shattering of wooden bats without significantly altering the performance characteristics of the bats.

The following discussion is directed towards the ubiquitous baseball bat. However, it will be appreciated that the principals of the invention can be readily adapted to other wooden athletic implements and to wooden tools and objects in general so as to solve the common problem of flying fragments released when wood fails catastrophically. Although seemingly simple, a baseball bat is a carefully designed and fabricated object. A bat is circular in cross-section, and the bat is divided into several regions. The thickest part of the bat, the region where the bat is meant to impact the ball, is known as the barrel. The barrel ends at one end in a generally rounded tip. The portion of the barrel intended to interact with the ball is usually called the sweet spot. Below the sweet spot (opposite the tip) the barrel narrows, and becomes the handle. Compared to the barrel the handle is quite thin to accommodate the batter's grip. At the end of the bat proximal the handle is a knob (a widening of the handle) to prevent the bat from sliding out of the batter's grip.

Although the baseball has been traditionally carved or machined from wood, it can also be constructed of metal or composite materials. Professional (Major League) baseball rules, however, require wooden bats, and there currently appears to be an overall trend in favor of wooden bats as opposed to those of manmade materials. The most common wood traditionally used to construct baseball bats was ash although hickory wood was also commonly used. Ash mostly displaced hickory because ash is somewhat lighter. In the last decade or so there has been a move away from ash to maple as the wood of choice for baseball bats. This change seems to have been driven by the use of maple bats in plays that shattered a number of world records. Unfortunately, while any wooden bat might occasionally shatter, maple bats themselves have a tendency to shatter at a higher frequency.

As explained above, there have been a variety of proposals for dealing with the safety hazards related to shattering bats. The present inventor has developed a far simpler and more direct way to add safety to maple bats or any bat or other wooden object that is at all likely to shatter. The inventor has discovered that it is possible to apply a very thin but durable polymeric film to the surface of a baseball bat. The effective films are remarkably thin—generally 2 mil (2 thousandths of an inch or 0.051 mm) to 20 mil (20 thousandths of an inch or 0.51 mm)—so that it has negligible weight and little if any effect on the bat's operation. Suitable films are available as "paint protective films" such as Scotchgard™ Paint Protective Films or XPEL Paint Protective Films. These protective films are designed to protect automotive and other painted surfaces from impact damage or stains. However, the inventor discovered that the unusual tensile strength of these protective films unexpectedly lends itself to retaining the fragments of a shattered bat. These films are most often aliphatic polyurethane films although polyester (e.g. polyethylene terephthalate), polyethylene, polypropylene, polyamide (e.g. nylon) and other polymeric films known to one of ordinary skill in the art can be used in the present invention. The films are generally supplied with an adhesive coating affording ready application to a clean surface; however it is also possible to apply adhesives to the film immediately prior to or during the application process.

Thus, the present invention does not directly strengthen the wood to prevent shattering—as proposed in some other solutions to the shattering problem. Rather it envelops the bat and greatly reduces the probability of any fragments from flying when the wood does shatter. Thus, the current invention is usable with any of the problem solutions suggested above. Even if imaging technology reduces the tendency of maple bats to shatter, the present invention will provide an addition safety barrier and prevent injury from the few bats that do shatter. Even if "super maple" trees were perfected, the present invention could prevent injury should any of the "super" ultimately wood shatter.

The protective film is so light and invisible that it can readily be used to cover essentially the entire surface of the baseball bat. However, it is apparent from experience that it is the thinner handle portion of the bat that is far more likely to fail. Therefore, it is most important to cover at least that portion of the bat. Although it is believed that the film has no effect on the sweet spot of the bat, it is likely that game rules and player preferences will militate against complete covering of the sweet spot. Therefore, the inventor has developed various embodiments in which only part of the bat's barrel is covered. This leaves an area of the sweet spot uncovered so that there can be no question with the film modifying the hitting properties of the bat. While it is possible to mark the uncovered sweet spot in a number of different ways, it is convenient to use colored protective film so that the uncovered area is readily apparent.

FIG. 1A shows a shape 10 cut from protective film as well as the cut shape 10 applied to a regulation wooden baseball bat 12 (FIG. 1B—the bat 12 is shown twice so that both sides of it are visible). Note that the film 10 is sized and shaped to completely envelop the handle and the transition zone 14 between the handle 18 and the barrel 16 of the bat. However, a majority of the barrel 16 is left uncovered. Only relatively narrow strips 20 of film extend up opposite sides of the barrel 16 and meet at the tip of the bat which is entirely covered. The advantage of this configuration is that the handle and the transition zone 14—where failure of the wood is most likely to occur—are completely enveloped. Should failure occur in these areas, any fragments or shards should be retained by the film. It is unlikely that failure will occur in the barrel 16, but the side strips 20 and the film at the bat tip ensure that the barrel 14 will remain attached to the handle (and not go flying in case of any failure). Further, in the unlikely case that the barrel were to fragment, this arrangement greatly reduces the probability of the large fragments flying free. At the same time the sweet spot is left uncovered and the film pattern makes it easy for the batter to strike the ball with bare wood. Note that according to Major League Baseball rules the handle and transition zone 14 have a maximum length of 18 in. while the barrel 16 varies between 29 and 35 inches.

Figure 2:
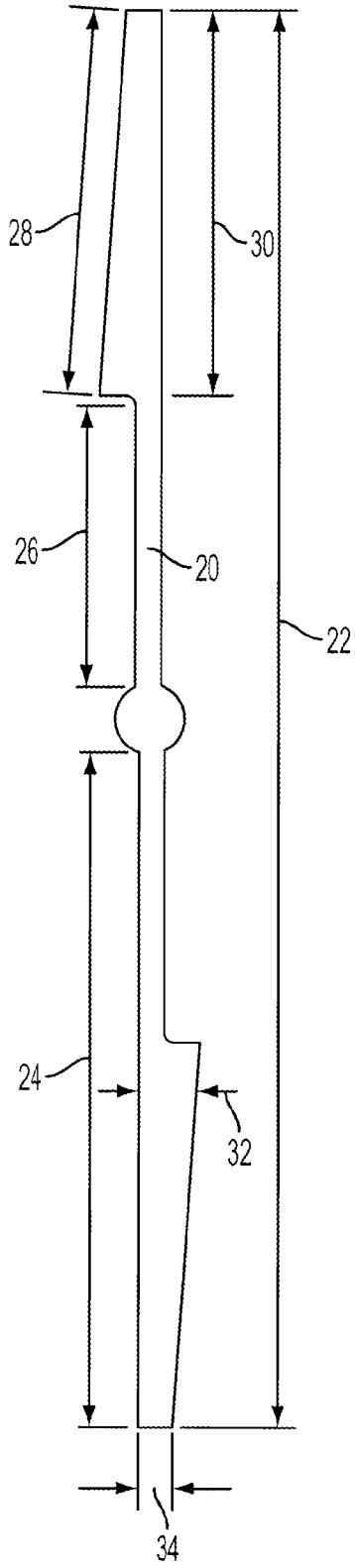
FIG. 2 shows a schematic view of cut protective film for a different embodiment of the current invention.

FIG. 2 shows a detail of the precise shape of the film cut out to perform as just described. In this example the entire length 22 of the film is 5 ft.-8 in. The length of one segment 24 is 2 ft.-8 5/16 in. The length 26 of the narrow strip 20 is 1 ft.-1 7/16 in. The length of the diagonal side 28 of the handle-transition region is 1 ft.-6 9/16 in. The length of the other side 30 of the handle-transition region is 1 ft.-6½ in. The widest part 32 of the handle transition region is 2 15/16 in., and the narrowest part 34 of the handle-transition region is 1⅝ in. The dimensions are appropriate for the specific bat a hand, but are adjusted depending on the size of the bat. The cut film shown in FIG. 2 can be applied by locating the tip of the bat at the "+" shown in the center of the cut film. The straight segments are adhered to the side of the barrel, and the triangularly shaped sections are wrapped around the transition zone and the handle. The precise techniques used to apply paint protective films are well known to those of ordinary skill in the art. Generally, the film is cut to shape using a plotter, although any means of cutting the film is useable. The preferred film comes with adhesive on one side covered by a backing. The backing is then peeled off and the film is applied to the bat. Heat can be applied to improve contact of the film. Films or any color (as for team colors) or clear films can be used. In addition, it is possible to print decorations, logos, names or sponsor messages on the film.

Figure 3:
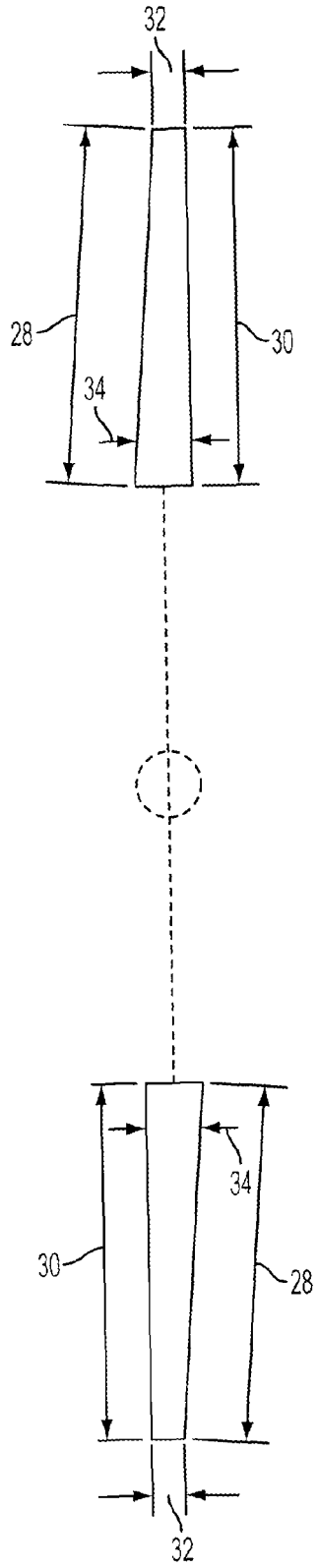
FIG. 3 shows a schematic view of cut protective for another embodiment of the current invention.

It is also apparent to one of ordinary skill that the precise structure is adaptable to meet various rules and regulations. For example, Major League Baseball Rule 1.10(c) states: "it is not allowed to have a foreign substance on the bat more than 18 inches up from the bottom handle . . . " This requirement would militate against the side strips shown in FIGS. 1 and 2. FIG. 3 shows an embodiment intended to satisfy Rule 1.10(c). Note that the side strips and tip cover are missing. However, the polymeric film is cut so that two pieces overlap to give reinforced covering up to 17" from the bottom handle (maximum length 30 of the film) with diagonal lengths 28 of 17.075 in. For ease of understanding and comparison to the earlier figures, the two pieces are shown as being entirely separate. In actual practice they are often cut from the film so that they are immediately adjacent each other and are either continuous along their longest edges 30 or attached by a small "tether" of film. The film may be cut in various patterns to produce a "mesh" so as to improve the grip. In this example the widest part of the film segments 34 is 2.875 in and the narrowest measurement 32 is 1.675 in.

Figure 4:
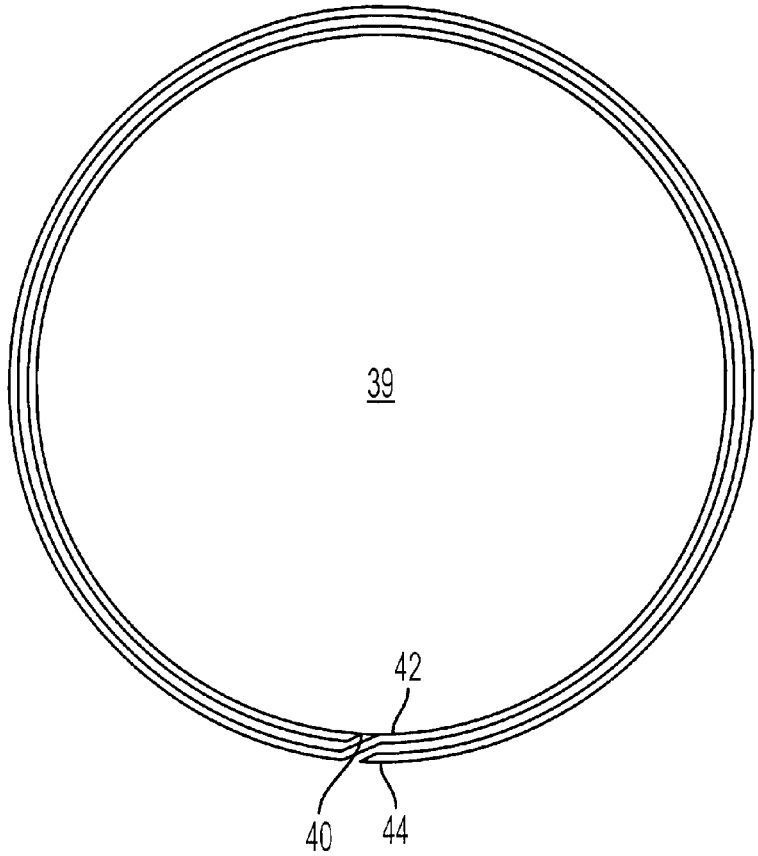
FIG. 4 shows a diagrammatic cross-section of a bat showing a preferred way to wrap the protective film around the bat.

It has been discovered that a superior version of the lower 17 inch coverage shown in FIG. 3 can be achieved by overlapping the film. FIG. 4 is a cross-section of a bat 39 illustrating this configuration. The film (thick black line) starts a point 40 and is wound around the bat in a clockwise direction. When a point 42 just before the starting point 40 is reached, the film steps up and begins to overlap the original layer of film. The overlap is ended at point 44 just above the step up, and the end of the film is trimmed at an angle to butt together smoothly with an essentially invisible seam. Note that the bat is smoothly covered by two layers of the polymeric film. If desired, the wrapping can be continued to produce three or more layers of film. Tests have shown excellent results with a two layer wrap of 6 mil (0.152 mm) film. Thinner film might be preferable if more than two layers are desired.

As mentioned above in relation to FIG. 3 the overlapping wrap shown in FIG. 4 can have several different configurations. Players might object to having the film prevent their hand from actually touching the wooden grip of the bat. Thus, the major league configuration illustrated in FIG. 3 can be modified so that the film does not cover the lower 3 or 4 inches of the bat, leaving the bottom end of the bat uncovered so that the player's hands directly grip the wooden surface of the bat.

Figure 5:
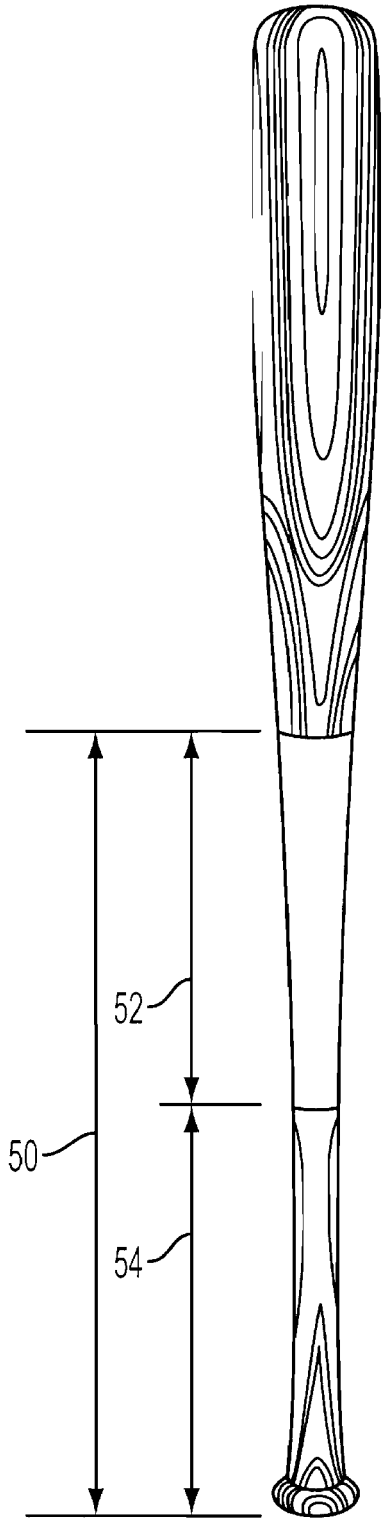
FIG. 5 shows a side view of an inventive bat with the transition region wrapped with protective film.

FIG. 5 shows a first or "major league hand free" option. The distance 50 from the lower end of the handle to the end of the transition zone is 17 in. However, the region 54 of the handle up to 9.25 in. from the lower end is left uncovered to allow the player to have a large area of bare wood for directly gripping the bat. The upper region 52 is 7.75 in. in length and is covered by film. Again, the length of region 50 is controlled by Major League Baseball rules (actually, the film could extend up to the 18 in. point—that is to say that region 50 could extend up to the 18 in. point in any of the examples) but the other regions can vary considerably in length.

Figure 6:
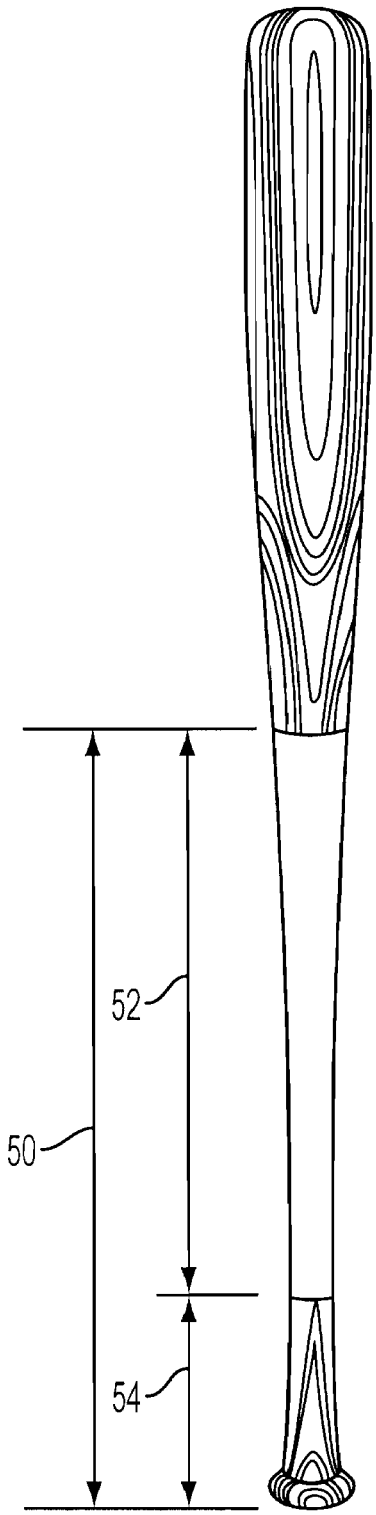
FIG. 6 shows a side view of an inventive bat with the transition region and most of the handle region wrapped with protective film.
Figure 7:
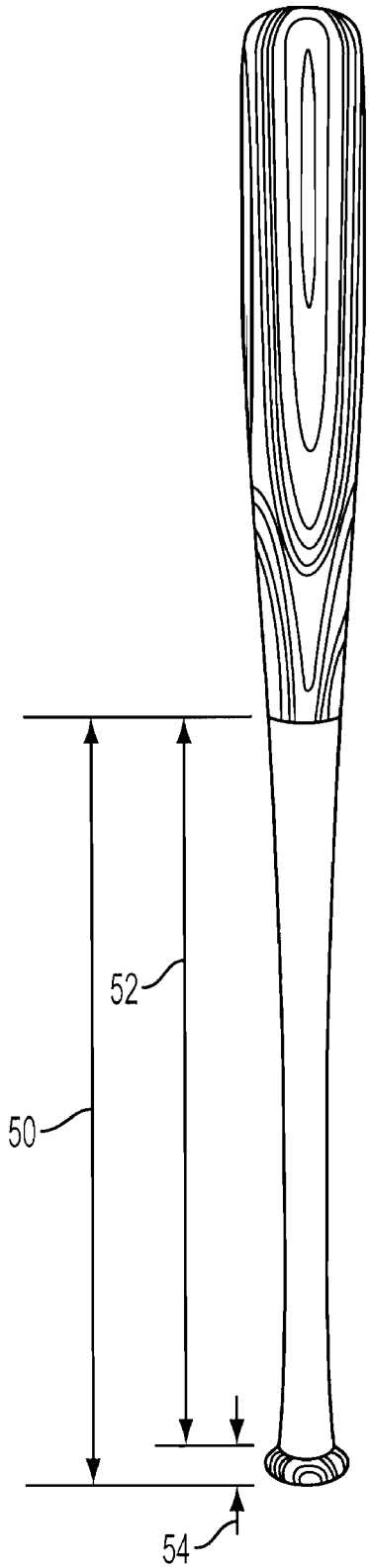
FIG. 7 shows a side view of an inventive bat with the transition region and the handle region wrapped with protective film.

FIG. 6 show a second variation wherein the bare portion of the handle 54 extends only from the lower point to a point 4.625 in. above that point. This leaves the film covered region 52 with a length of 12.375 in. FIG. 7 shows a third option where region 52 is 16.5 in. in length so that the entre lower region of the bat except for the knob are covered by the overlapped film. The uncovered region 54 is about 0.5 in. in length. It should be kept in mind that only the 17" point is absolutely fixed as it is controlled by major league baseball rules. The other measurements shown (i.e., how much of the handle is left bare) can be adjusted according to player preference. However, the third option (FIG. 7) shows the configuration least likely to release fragments should the bat fragment in use.

Figure 8:
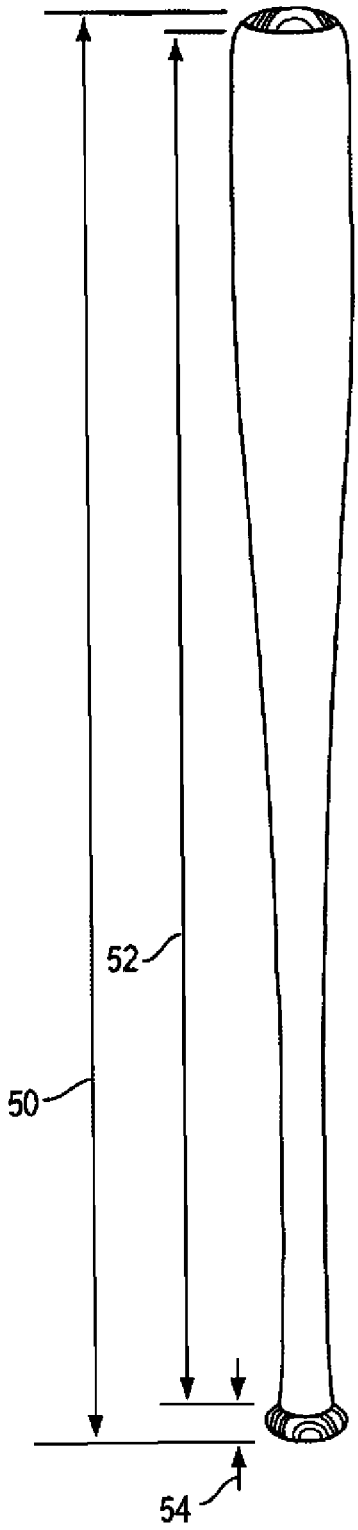
FIG. 8 shows a side view of an inventive bat with the transition region and the handle region wrapped with protective film.

FIG. 8 illustrates a fourth option that does not satisfy Major League Baseball rule 1.10. In this example the only uncovered portion is region 54 which is about 0.5 in. in length. In addition, the top of the bat is uncovered; however, essentially the entire length of the bat including the entire barrel is covered. This option offers the ultimate protection from flying bat fragments. It is intended for sale through usual retail outlets (e.g., sporting good store) for use in little league, high school and college baseball. The total length 50 of the bat may be up to 42 in. and still fall within the general rules governing bat dimensions. This option can be readily modified by leaving an opening in the covering of the barrel so that a portion of the "sweet spot" of the bat is left uncovered.

It will be apparent to one of ordinary skill in the art, that many variations are possible. For example, in configurations where film bands run the length of the bat, the bands of film running up the sides of the barrel to the tip can be widened. While this will reduce the uncovered area it will serve to retain smaller fragments should a catastrophic failure occur. The side bands can also be connected by various patterns of narrow bands of film—again reducing the uncovered area available for striking the ball. The material covering the handle can be but in strips to produce a mesh, etc. While the native polymeric film is glossy, a fine grade sandpaper can be used to apply a matte finish to the film to render it even less apparent. In addition, matte finishes can be sprayed onto the film to reduce gloss.

It will be understood that in order to be used in Major League Baseball, the inventive bats must have performance characteristics very similar or identical to normal wooden bats. That is, except for the protective aspect of the treated bat, the bat must otherwise perform the same as untreated bats. Therefore, a series of tests was completed to investigate the performance and durability of inventive bat relative to that of traditional solid northern white ash wood bats. All tests, comparing solid ash bats and inventive bats, were conducted in a laboratory. Batted-ball performance comparisons were made using the procedures developed for certifying non-wood bats for use in college and high school baseball. A bat design must have a minimum of 15/16-in (0.938-in) handle diameter to be considered for approval. The inventive bats tested both had minimum handle diameters of 0.960 in., which was greater than the minimum of 0.938 in.

The tests concluded that in addition to an appearance that is very similar to ordinary solid-wood bats, the inventive bats have a very similar feel and sound to their solid-wood bat counterparts. The polymeric film wrap in the bat taper is smooth to the touch. The polymeric film feels slightly softer than wood. The sound of the bat when tapped to the ground generates the same sound as the solid-wood bats without the film.

TABLE 1

Dimensions of Tested Bats

| Type | Length (in.) | Weight (oz.) | CG (in. from barrel end) | MOI (@ 6-in. oz in$^2$) | Minimum Handle Diameter | Barrel Diameter (@ 6-in. from tip) |
|---|---|---|---|---|---|---|
| Ash | 33.750 | 31.340 | 11.125 | 11061 | 0.946 | 2.437 |
| Ash | 33.750 | 31.270 | 11.000 | 11115 | 0.948 | 2.432 |
| Inventive | 34.063 | 32.370 | 11.250 | 11674 | 0.960 | 2.453 |
| Inventive | 34.063 | 32.515 | 11.125 | 11841 | 0.960 | 2.461 |

Table 1 summarizes the length, weight, barrel diameter, center of gravity (CG) and mass moment of inertia (MOI) for two inventive (solid-ash bats with the polymeric film applied) and two similar solid-wood ash bats. The MOI is effectively the measurement of the "swing weight" of the bat. The MOIs of the inventive bats are very slightly greater than their solid-ash counterparts. This difference in MOI and weight is primarily a consequence of the inventive bats being about 5/16-inch longer than the ash bats supplied due to chance manufacturing variation. The inventive and ash bats have very similar barrel dimensions.

Batted-ball performance testing was used to evaluate if the inventive solid-ash bat has any performance difference from that of comparable length and weight solid-ash bats. Batted-ball performance testing was conducted using an air cannon test system that fires a Major League baseball at 136±2 mph into the baseball bat that is at rest and mounted on a pivot allowing the bat to rotate freely after impact. These tests were performed in accordance with the ASTM Standard F2219-05 and the NCAA Baseball Bat Certification Protocol (November 2005). The Ball Exit Speed Ratio (BESR) and the batted-ball speed (BBS) based on the test speeds were calculated. Both of these performance values were calculated and compared for the inventive (solid-ash bat with the protective film) and the solid-ash bat. The performances of both bats are compared to determine if there is a performance advantage of swinging either bat. Table 2 identifies the length, weight, and MOI of both the ash bat and the composite bat. The BESR and associated batted-ball speed of each bat were identified for the sweet-spot location. Per the ASTM standard, this batted-ball speed is based on a pitch speed of 70 mph (~80 mph out of the pitcher's hand) and a bat swing speed of 66 mph at the 6-in. location (~80 mph at the tip of the barrel). Both bats have very similar performances and the inventive bat does not give any performance advantage over a solid-ash bat. The slight MOI differences between the bats would result in very similar performance values of BESR and batted-ball speed when swung in the field.

TABLE 2

| Type | Length (in.) | Weight (oz.) | MOI (@ 6-in. oz in$^2$) | BESR | Batted-Ball Velocity (mph) | Sweet Spot (Distance from barrel tip in in.) |
|---|---|---|---|---|---|---|
| Solid Ash | 33.750 | 31.270 | 11115 | 0.735 | 97.8 | 6.0 |
| Composite | 34.063 | 32.370 | 11674 | 0.739 | 98.3 | 6.0 |

Thus, the testing demonstrated that the inventive bats have performance properties that are extremely similar to ordinary wooden bats. Essentially, the only effect of the inventive method is to retain fragments when a bat shatters. In all other respects the bats are the same as ordinary wooden bats.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A method for treating a wooden baseball bat to prevent the release of fragments should the baseball bat shatter during use, the method comprising the step of wrapping at least two layers of polymeric film around at least a transition portion between a barrel portion and a handle portion of the wooden baseball bat, wherein one surface of the polymeric film bears an adhesive, which adhesive adheres the film to the baseball bat and to any overlapped polymeric film and wherein addition of said at least two layers of polymeric film does not alter the performance properties of the baseball bat.

2. The method according to claim 1, wherein the barrel portion of the bat remains at least partially uncovered by the polymeric film.

3. The method according to claim 2, wherein the barrel portion of the bat remains uncovered by the polymeric film.

4. The method according to claim 1, wherein a length of the handle portion of the bat remains uncovered by the polymeric film.

5. The method according to claim 1, wherein the polymeric film is formed from polymers selected from the group consisting of polyurethanes, polyesters, polyethylenes, polypropylenes and polyamides.

6. A wooden baseball bat improved to prevent the release of fragments should the bat shatter during use made according to claim 1.

7. A method for treating a wooden baseball bat to prevent the release of fragments should the baseball bat shatter during use, the method comprising the step of smoothly wrapping at least two layers of light weight polymeric film of no more than 20 thousandths of an inch thick around at least a transition portion between a barrel portion and a handle portion of the wooden baseball bat, wherein one surface of the polymeric film bears an adhesive, which adhesive adheres the film to the baseball bat and to any overlapped polymeric film and, wherein addition of said polymeric film does not alter the performance properties of the baseball bat.

8. The method according to claim 7, wherein the barrel portion of the bat remains at least partially uncovered by the polymeric film.

9. The method according to claim 8, wherein the barrel portion of the bat remains uncovered by the polymeric film.

10. The method according to claim 7, wherein a length of the handle portion of the bat remains uncovered by the polymeric film.

11. The method according to claim 7, wherein the polymeric film is formed from polymers selected from the group consisting of polyurethanes, polyesters, polyethylenes, polypropylenes and polyamides.

12. A wooden baseball bat improved to prevent the release of fragments should the bat shatter during use made according to the method of claim 7.

* * * * *